US009364835B2

(12) United States Patent
Schwelling

(10) Patent No.: US 9,364,835 B2
(45) Date of Patent: Jun. 14, 2016

(54) UNIT FOR SUPPLYING SHEET-LIKE MATERIAL FOR A DOCUMENT SHREDDER

(71) Applicant: Hermann Schwelling, Salem (DE)

(72) Inventor: Hermann Schwelling, Salem (DE)

( * ) Notice: Subject to any disclaimer, the term of this patent is extended or adjusted under 35 U.S.C. 154(b) by 0 days.

(21) Appl. No.: 14/602,069

(22) Filed: Jan. 21, 2015

(65) Prior Publication Data

US 2015/0224511 A1 Aug. 13, 2015

(30) Foreign Application Priority Data

Jan. 22, 2014 (DE) ..... 10 2014 100 716

(51) Int. Cl.

| | |
|---|---|
| ***B65H 3/06*** | (2006.01) |
| ***B02C 18/22*** | (2006.01) |
| ***B02C 18/00*** | (2006.01) |
| ***B65H 5/06*** | (2006.01) |

(52) U.S. Cl.

CPC ..... *B02C 18/2283* (2013.01); *B02C 18/0007* (2013.01); *B65H 3/0638* (2013.01); *B65H 5/06* (2013.01); *B02C 2018/2208* (2013.01)

(58) Field of Classification Search

CPC ..... B65H 1/06; B65H 3/06; B65H 3/063; B65H 3/0638; B65H 3/0676; B65H 2404/10; B65H 2404/132; B65H 2404/135; B02C 18/2283; B02C 18/2007; B02C 2018/2208

USPC ..... 271/10.09, 10.11, 109

See application file for complete search history.

(56) References Cited

U.S. PATENT DOCUMENTS

| | | | | |
|---|---|---|---|---|
| 4,842,205 | A | 6/1989 | Araki et al. | |
| 4,893,759 | A | 1/1990 | Mizobata | |
| 5,429,313 | A | 7/1995 | Schwelling | |
| 5,897,065 | A | 4/1999 | Schwelling | |
| 7,721,982 | B2 | 5/2010 | Schwelling et al. | |
| 8,061,635 | B2 * | 11/2011 | Kim et al. | 241/36 |
| 2011/0068530 | A1 * | 3/2011 | Ahn et al. | 271/10.11 |
| 2015/0083833 | A1 | 3/2015 | Schwelling | |

FOREIGN PATENT DOCUMENTS

| | | |
|---|---|---|
| DE | 2214800 | 9/1973 |
| DE | 3614028 | 10/1987 |
| DE | 102006028828 | 12/2007 |
| DE | 102008009236 | 8/2008 |
| WO | 2008131942 | 11/2008 |
| WO | 2008131943 | 11/2008 |
| WO | 2009012942 | 1/2009 |

* cited by examiner

*Primary Examiner* — David H Bollinger

(74) *Attorney, Agent, or Firm* — Kolisch Hartwell, P.C.

(57) ABSTRACT

The invention relates to a unit for supplying sheet-like material for a document shredder, wherein the unit has a main body on which a paper support having a support face is disposed such that by at least one conveying element in each case one sheet is successively drawn off a stack of paper/sheet-like material which is supported on the support face and conveyed toward a supply slot of the document shredder, wherein the at least one conveying element is a conveyor roller, the sleeve face of which includes a multiplicity of structured part-areas such that the static friction between this conveyor roller and the respective sheet is increased.

14 Claims, 6 Drawing Sheets

9 / 9a / 9b

UNIT FOR SUPPLYING SHEET-LIKE MATERIAL FOR A DOCUMENT SHREDDER

The invention relates to a unit for supplying sheet-like material for a document shredder, in particular for supplying paper, documents and similar material, by way of which automatic paper infeeding for continuously infeeding the sheet-like material is performed.

Document shredders of the mentioned type of design having an automatic paper infeed for continuously infeeding the material are known in a wide range of implementations in the prior art, for example a tearing machine according to U.S. Pat. No. 4,842,205, a paper shredder according to U.S. Pat. No. 4,893,759, a document shredder with a supply unit according to U.S. Pat. No. 7,721,982 B2, a supply device for printed-matter shredders according to DE3614028 C2, a comminution device according to DE2214800 A, a document shredder according to DE102006028828 A1, or a device for comminuting sheets presented in a stack by way of cutting, according to U.S. patent application Ser. No. 14/493,000, now published as US20150083833 A1.

Other applications of interest include WO2008131943 A1 and WO2008131942 A1. The disclosures of these and all other publications referenced herein are incorporated by reference in their entirety for all purposes.

The sheets/papers to be comminuted are typically composed of utilized/used sheets. The properties and the state of these used sheets, in particular the surface thereof, which in part have been imparted an invisible layer which however, on account of manual handling, is partially slippery, are such that in the case of automatic infeeding/drawing-off of a sheet from a paper stack in a supply unit, disruptions will occur to a lesser or greater extent because adjacent sheets adhere to one another on account of such a layer. In the case of known supply devices, such as for example in that of DE3614028 C2, pin-type driver elements which radially protrude from the sleeve face of the conveyor roller are disposed for this reason on the indexing element, i.e. the conveyor roller. In practice, these pin-type driver elements have often penetrated a plurality of sheets, such that a plurality of sheets instead of only one sheet has been supplied to the cutting unit, this not being the intention. This disadvantage has most often arisen when, for example, the parts of the supply device have not been optimally adjusted or when, counter to the conceived application of the document shredder, comparatively significantly thinner paper has been presented.

Moreover, in the case of the sheet-like material which is inserted in the form of paper stacks into the unit for supplying sheet-like material, to some extent a plurality of sheets may be joined together by a paper clip or a staple. Here too, disruptions arise when a sheet is drawn off from the paper stack and conveyed onward to the cutting unit of the document shredder.

The object of the invention therefore lies in providing a unit for supplying sheet-like material for a document shredder, in particular paper, documents, and similar materials, by way of which the mentioned disadvantages of the devices according to the prior art are at least minimized or eliminated, respectively. Moreover, this unit for supplying should be attachable with little assembly effort to document shredders which are already employed, or employable on various document shredders of a range of models.

The object is achieved according to the invention by a unit for supplying sheet-like material for a document shredder, having the features of claim 1. Variants of embodiments of the unit for supplying sheet-like material for a document shredder, according to the invention, are disclosed in the dependent claims 2 to 11 as well as in the drawings associated with the application in conjunction with the list of reference signs, as well as in and in the context of the following description of the invention.

The new unit for supplying sheet-like material for a document shredder, henceforth referred to in short as a supply unit, is a modular functional group which is placeable on and attachable to the upper side of a document shredder. The drive of the supply unit preferably is connected to the drive of the cutting unit of the document shredder.

If the new supply unit is to be retrofitted to a document shredder which is already in use, the supply unit is provided with a dedicated, autonomous drive. In this event, the drive of the supply unit and the control unit of the document shredder preferably are electrically/electronically intercoupled. This coupling achieves that a start command is also provided to the drive of the supply unit when the on switch of the document shredder is activated; preferably, the cutting unit starts up prior to the drive of the supply unit. The document shredder is composed of a housing. The housing, on the inside, in the upper region thereof, has a cutting unit. A supply slot leads from the upper side of the housing to the cutting unit. The material to be comminuted is supplied through this supply slot to the cutting unit. A space in which, for example, a collection container is disposed in a removable manner is provided in the housing of the document shredder, below the cutting unit. The material which is comminuted by the cutting unit is collected in this collection container. Said space, according to one implementation of document shredders, is selectively closeable by a door, such as in, for example, the case of the document shredder according to U.S. Pat. No. 5,429,313, by the applicant, the respective side of the document shredder usually also being referred to as the front side. According to another implementation of document shredders, the collection container and the door form a common functional group which is typically referred to as a collection bin. The collection bin is placed into the space such that the former is below the cutting unit, as is the case, for example, in the document shredder according to U.S. Pat. No. 5,897,065 or the document shredder according to WO2009012942 A1, both by the applicant.

A slot-shaped exit for the conveyed sheet of paper is disposed in the supply unit according to the invention, and the supply unit itself is disposed on the upper side of the document shredder, such that the conveyed paper is inserted into the supply slot.

The supply unit according to the invention is composed of a main body. Supporting parts which preferably are releasably fastened to the main body and by way of which the supply unit can be affixed to the upper side of the housing of the document shredder are provided on the sides of the main body. Means for a stack of sheet-like material to be supported thereon, and means for the sheet-wise removal and transport/conveyance of sheets which preferably have been drawn-off and in part displaced in a successive and individual manner from the stack of paper supported thereon with respect to continuous infeeding into the supply slot of the document shredder are then additionally disposed on the main body.

The means for the sheet-wise removal and transport/conveyance, or at least parts of said means, according to the invention are equipped with a newly designed surface by way of which the static friction between the conveying element of the means and the surface of the respective sheet of paper is increased in contrast to known devices, even when said sheet of paper, on account of its handling or contamination, has very smooth portions. Details pertaining to this special surface will be explained in more detail in the course of the description.

Moreover, according to one variant of embodiment of the supply unit, further means by which items, in particular staples, paper clips, and similar parts, still adhering in or to the sheet supplied to the cutting unit are removed during infeeding of the respective sheet and prior to reaching the duct which is directed toward the cutting unit are provided on the means for a stack of sheet-like material to be supported thereon, and/or on the means for the sheet-wise removal and conveyance in respect of continuous infeeding.

The invention closes the gap in the existing known prior art, such that also material having modest adhesive properties, that is to say paper having a contaminated or greasy surface, respectively, can be reliably drawn-off and conveyed onward in a sheet-wise manner from the (supported) stack of paper.

This document shredder, of which the supply unit (also referred to as an automatic supply unit) draws off individual sheets by way of continuous infeeding from a stack of sheet-like material and guides said sheets toward the cutting unit, has a simple construction.

The document shredder is started up, and continuous infeeding commences. Starting from the bottom the paper infeed of the supply unit successively draws off individual sheets of the supported stacked paper from said stack and guides each sheet toward the supply slot.

The present invention is of very simple construction, operates in a safe and reliable manner, and is straightforward and rapid. Other advantages of the invention include:

- the paper supply enables a double function, that is to say an autofeed supply from the paper stack, and at the same time manual supply of individual sheets of small amounts of paper, CDs/DVDs, or credit cards;
- reliable infeeding is also provided in the case of stapled, bound or crumpled media; and
- reliable operation is ensured also in the case of continuous loading;
- moreover, very quiet running during operation is achieved by way of optimal tuning of the drive elements of the cutting unit and of the paper supply.

By way of the new supply unit a high-performance sheet infeed which is distinguished by a special surface property/surface structure of the sleeve face of the infeed roller and/or of the conveying roller is achieved. Various materials, such as paper, labels, or films, having a rough, structured, or smooth to very smooth, or greasy surface are infed in a reliable manner.

Advantages of the present disclosure will be more readily understood after considering the drawings and the detailed description. The drawings illustrate embodiments and schematic concepts according to the invention. The purpose of these drawings is to aid in explaining the principles of the invention. Thus, the drawings should not be considered as limiting the scope of the invention to the embodiments and schematic concepts shown therein. Other embodiments may be created which follow the principles of the invention as taught herein, and these other embodiments are intended to be included within the scope of patent protection.

Further details, features, and advantages of the invention are stated and explained in more detail in the following part of the description and, moreover, are disclosed in conjunction with the description and the exemplary embodiments of the invention, which are illustrated in a schematic manner in the drawings, in which.

Figure 3:
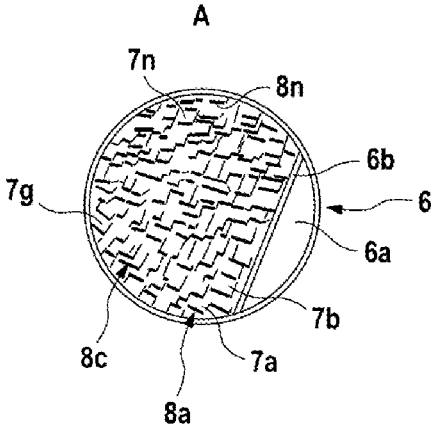
Figure 2:
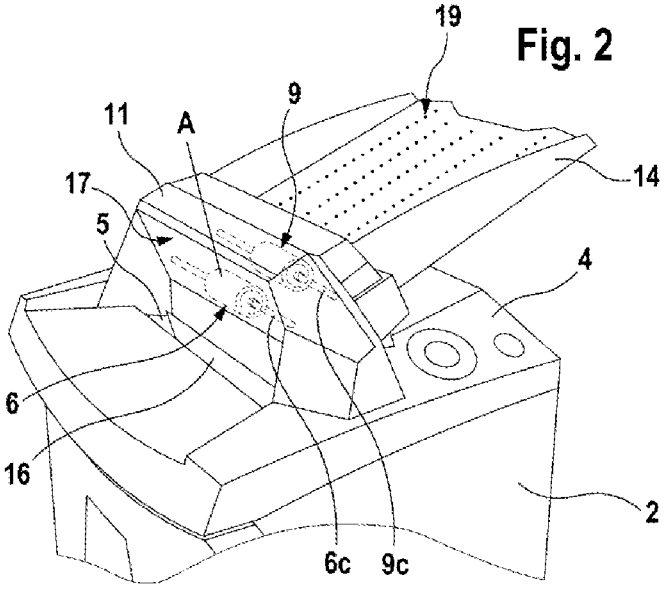
FIG. 2 shows details on/in the new supply unit.
Figure 3A:
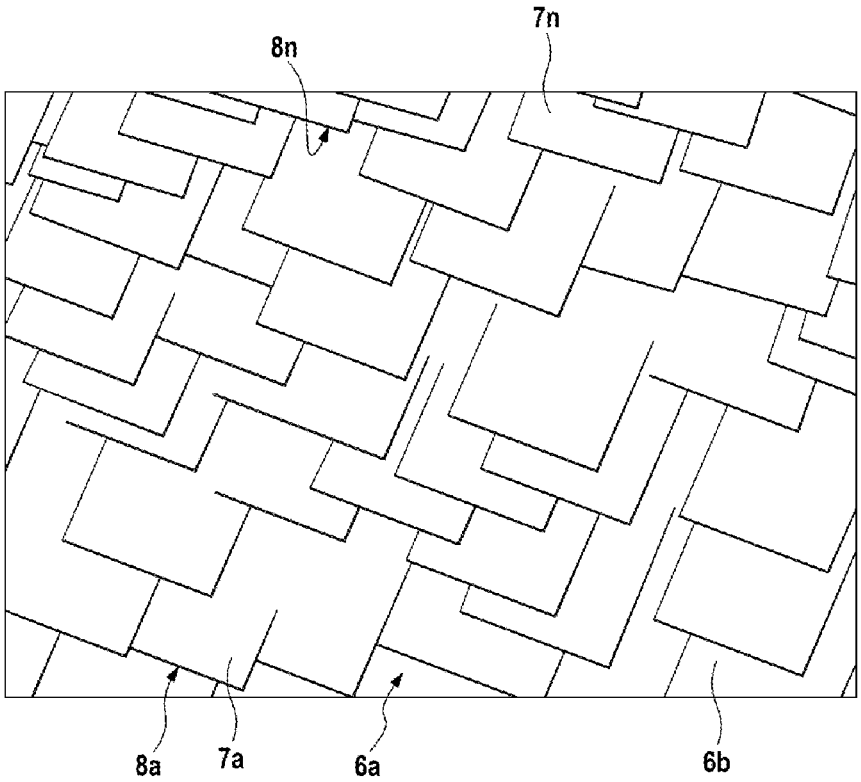
Figure 3B:
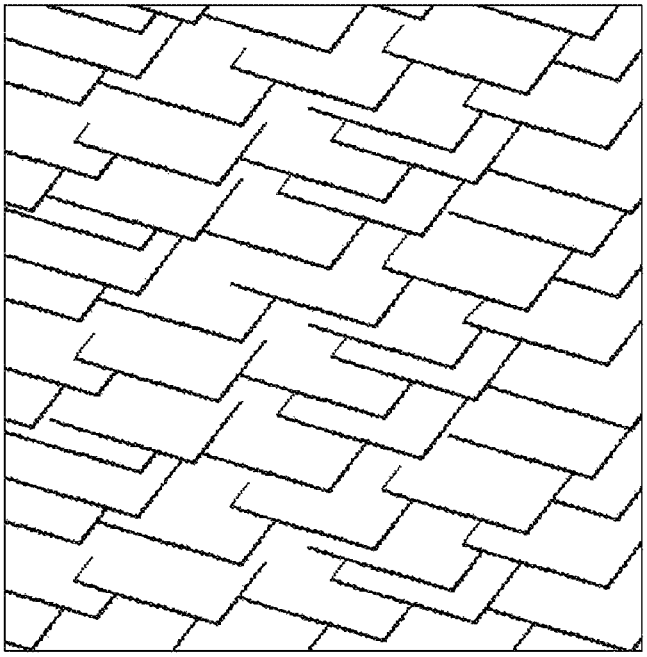
Figure 4:
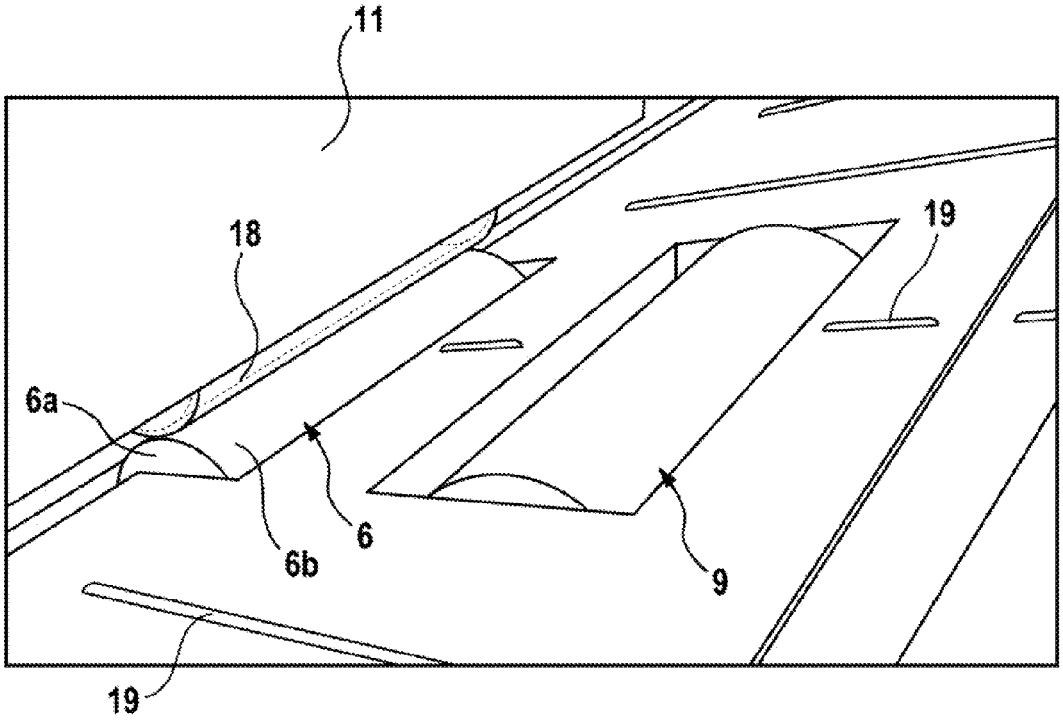
Figure 5:
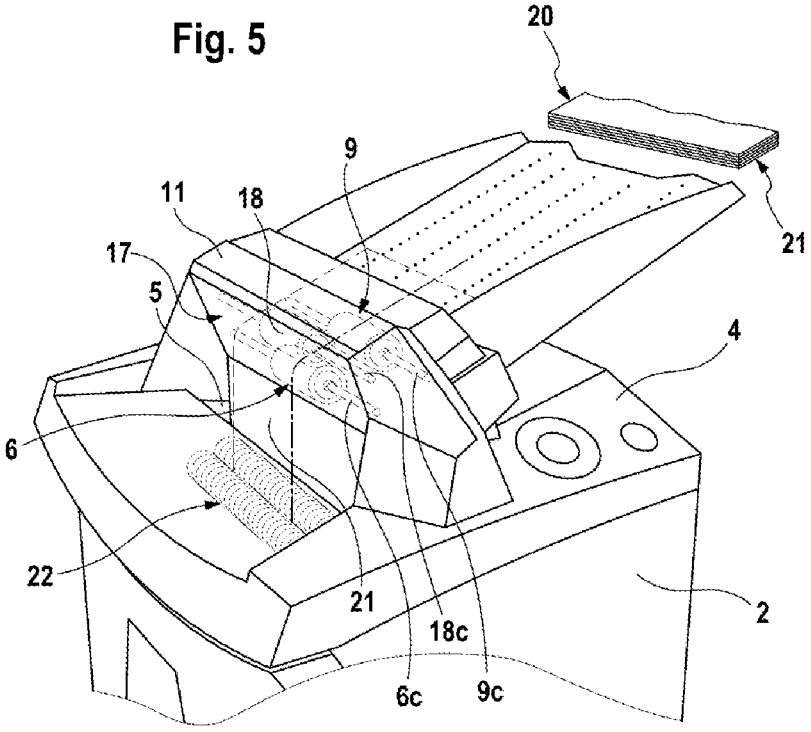

FIGS. 3, 3*a*, and 3*b* show details of the sleeve face of the conveyor rollers of the supply unit;

FIG. 4 shows a detailed view of the supply unit, looking onto the paper support and the conveyor rollers; and FIG. 5 shows a complementary illustration to that of FIG. 2.

The following narrative is preceded by clarifying that terms such as "top", "bottom", "left", and "right" refer only to the respective illustration in the figures, and that the actual positioning may deviate from this terminology. Dimensioning of the real components may also deviate from the dimensioning used in the figures. It is furthermore highlighted that same components in the various figures are always provided with the same reference sign; moreover, said components in each case also have the same significance, even if they are not expressly mentioned in the description of the variants of embodiment of each figure.

Figure 1:
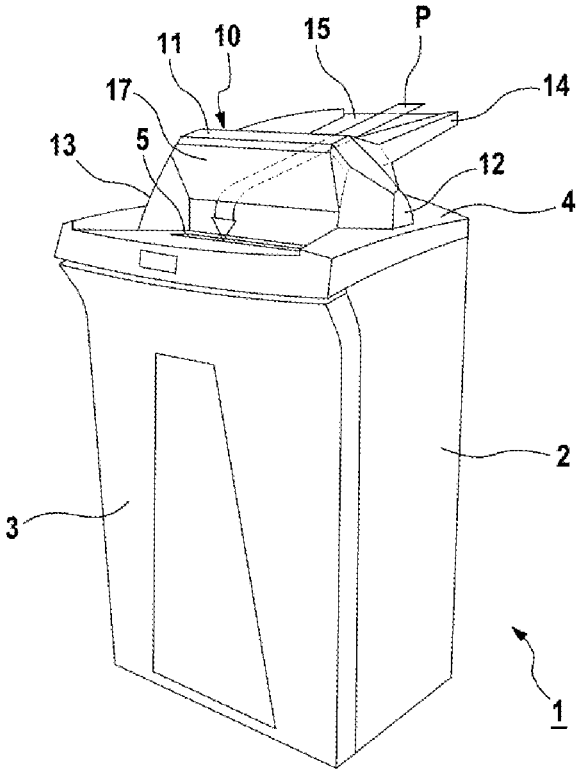
FIG. 1 shows a perspective view of a document shredder having a supply unit according to the invention.

A document shredder 1 onto which a supply unit 10 according to the invention has been placed is shown in FIG. 1. The document shredder is composed of a housing 2, the receiving space of which is closed off by a door 3. A collection container for the cut goods which are produced is disposed in the receiving space behind the door 3. The cutting unit 22 of the document shredder 1 (cf. FIG. 5), which in its type is known per se and is disposed at the usual position and, therefore, not shown in FIG. 1, is disposed in the upper region of the housing 2, mainly in the upper housing part 4. A supply slot 5 leads from the upper side of the upper housing part 4 toward the cutting unit.

The new supply unit 10 has a main body 11 in which the first conveyor roller 6 of the former and the second conveyor roller 9 of the former are disposed and are held in a rotatable manner, cf. also FIG. 2. Supporting parts 12 are provided laterally on both sides on the main body 11 and disposed such that it 10 in conjunction with at least one guide part 13 is disposed in a region behind the supply slot 5, that is to say when presently viewed from the front side of the document shredder, so that the slot-shaped exit in the main body 11 is disposed so as to correspond with the supply slot 5 in such a manner that the paper, which is drawn-off from the paper stack and conveyed in a sheet-wise manner by the supply unit, makes its way into the supply slot 5 with its end side which leads in the conveying direction. The slot-shaped exit in the main body 11 preferably is disposed so as to be correspondingly inclined. In the illustration according to FIG. 1 the slot-shaped exit is concealed by a central front plate 17 of the main body 11.

The inner face of the central front plate 17, which points in the direction of the conveyor rollers 6 and 9, at least one portion of the inner face of the central front plate, is designed such that it is a guide element by way of which moving a sheet toward the supply slot 5 is facilitated.

According to one variant of embodiment of the invention, the entire inner face, or only one or a plurality of part-portions thereof, is/are configured as a guide element.

According to a further variant of embodiment of the invention, the provided guide element(s) is or are, respectively, implemented in the manner of a deflection rocker. This offers the further advantage that in particular the deflection of conveyed sheets which are comparatively rigid, that is to say sheets having an above-average sheet thickness, is disruption-free. By way of the deflection rocker the respective deflecting portion of the conveying path which leads toward the supply slot 5, more specifically of the conveying duct formed, is variable within prescribed limits in relation to its position with respect to the leading end side of the conveyed sheet 21.

On account of this mobility of the guide elements bending of the conveyed sheet in the curved or inclined portion, respectively, of the conveying path toward the supply slot is substantially facilitated and less prone to disruption. Compression of the leading end edge of the conveyed sheet 21 is avoided, as are disruptions when indexing the respective sheet 21.

The conveying direction of the paper from its initial position on the paper support 14 up to the supply slot 5 and into the latter is identified in FIG. 1 by the arrow P.

The paper support 14 has a support face 15 on which the paper to be comminuted in a stack 20 of pre-determined height is supported. The paper support 14, when viewed in relation to the supply slot 5, is disposed at the rear side of the main body 11. It is specifically disposed such that the two conveyor rollers 6 and 9 in each case by way of their circumferential face 6*b*; 9*b* partially engage through the support face 15 and thus come into contact with the lowermost sheet 21 of the paper stack 20, cf. also FIG. 4.

Ribs 19, by way of which friction between the respective lowermost sheet 21 and the support face 15 is reduced, are disposed on the support face 15 and oriented in the conveying direction P.

FIG. 2 shows details of the new supply unit 10, specifically the position of the first conveyor roller 6 and of the second conveyor roller 9 in the main body 11, and their position in relation to the support face 15 of the paper support 14, the illustration in FIG. 4 also being complementary thereto. The conveyor roller 6 is disposed on a rotation axle 6*c* and is rotatable therewith. The second conveyor roller 9 is disposed on a rotation axle 9*c* and is rotatable therewith. Both rotation axles 6*c* and 9*c* are mounted in lateral regions of the main body 11 so as to be rotatable. At least one of the two conveyor rollers 6 and 9, preferably the first conveyor roller 6, that is to say especially the rotation axle 6*c* thereof, is connected to or merely coupled to elements of the drive of the cutting unit, such that during operation of the cutting unit typically also at least one of the conveyor rollers 6 and 9 is subjected to a driven rotating movement.

Alternatively, the rotating movement of the respective conveyor roller or rollers is selectively de-couplable from the drive of the cutting unit, such that the supply unit 10 is not active in the case of only manual input of paper/material 16 into the supply slot 5, on account of which no unnecessary energy consumption takes place and the sound which inevitably occurs during operation of a document shredder is lower in its volume. Moreover, there is also no wear on moving parts of the supply unit 10 during this time.

According to the invention, at least the circumferential face/sleeve face 6*b* of the roller body 6*a* of the first conveyor roller 6, cf. FIG. 4, is specially designed, cf. FIGS. 3 and 3*a*; advantageously, the circumferential face/sleeve face 9*b* of the roller body 9*a* of the second conveyor roller 9 is also specially designed, cf. also FIG. 3*b*. Said sleeve face 6*b* and 9*b* has in each case a special surface structure which in its pattern has a rectangular scale structure.

On account thereof, a multiplicity of area portions 7*a* to 7*n* are formed in the sleeve face 6*b*, 9*b*. In a further special configuration these area portions 7*a* to 7*n*, when viewed counter to the conveying direction, at least in part-regions are inwardly inclined in the radial direction, that is to say inwardly toward the body. On account thereof, when viewed in the conveying direction P, at least edges 8*a* to 8*n* are formed on each area portion 7*a* to 7*n*, which edges 8*a* to 8*n* positively influence conveyance of a sheet of paper, even on contaminated surface points of the contacted sheet of paper or on surface points which have become smooth on account of use.

The radial height of these edges 8*a* to 8*n* in relation to the neighboring region of the neighboring area portion 7*a* to 7*n*, that is to say in their regions which are in each case inwardly inclined, is such that the entire sleeve face 6*b*, 9*b* of the conveyor rollers 6, 7 has a multiplicity of minute depressions, that is to say has a quasi nanostructure, that is to say is shaped in the manner of a "nano-grip area".

In the event of contact between the sleeve face 6*b* or 9*b*, respectively, and the surface of the respective sheet of paper 21 to be conveyed, these minute depressions act as suction pads, so to speak, which positively move the sheet, that is to say draw off said sheet from the supported paper stack, more specifically pull said sheet from under the paper stack 20 and displace it toward the supply slot 5.

FIGS. 3*a* and 3*b* show these new sleeve faces 6*b* or 9*b*, respectively, which have been specially designed according to the invention, that is to say their surface structure, in a substantially enlarged illustration; these are part-regions of the illustration of FIGS. 3 and 4, respectively.

In FIG. 5 the illustration of the document shredder 1 having the new supply unit 10, cf. also FIG. 1, is shown according to the illustration of FIG. 2, having further details. The surface of the upper housing part 4 and also wall parts of the main body 11 here are shown as being transparent in a special graphic illustration, such that the position of the cutting unit 22 of the document shredder 1 as well as that of the conveyor rollers 6 and 9 are shown from a somewhat different perspective.

A paper stack 20, which by way of its lowermost sheet 21 is supported on the support face 15 of the paper support 14, has been formed by a plurality of sheets of paper.

In the variant of embodiment shown here a further roller 18 is disposed above the first conveyor roller 6 and oriented so as to be parallel therewith. Like the conveyor rollers 6 and 9, this further roller 18 is laterally held by way of its rotation axle 18*c* in the main body 11 so as to be rotatable. The first conveyor roller 6 and the further roller 18 are disposed so as to be spaced apart from one another such that a gap for passing through sheet-like material, for example a sheet of paper, is formed therebetween.

This formed gap may at the same time be the slot-shaped exit which has been mentioned earlier. The width of the gap, that is to say the spacing between the two rollers 6 and 18, advantageously corresponds to a normally average thickness of a sheet of paper.

According to one variant of embodiment of the invention, the further roller 18, in order for the width of the gap to be variably adjustable, or for it to be capable of automatically adapting to the thickness of the respective sheet 21 being conveyed, is mounted so as to be movable in height, as shown in FIG. 4 in dashed lines.

In one further design embodiment of the invention this further roller 18 is driven or without drive.

According to a further variant of embodiment, like the sleeve faces 6*b*, 9*b* of the conveyor rollers 6 and 9, the circumferential face of this further roller 18 has area portions which are in the configuration of rectangular scales which preferably also have area regions which are inclined counter to the conveying direction and edges which radially project in the conveying direction.

By way of this further roller 18 separation of individual sheets from the supported paper stack 20 is facilitated and, at the same time, on account of the force which is exerted by this further roller in the direction of the first conveyor roller 6, adhesion between the drawn-off sheet 21 and the first conveyor roller 6 is increased. The force which is exerted by the further conveyor roller 18 is generated by the mass of the further conveyor roller or is complemented by means of spring elements.

While the features of the drawings identified above have shown a plurality of preferred embodiments, other embodiments according to the invention are also considered, as has been mentioned in the narrative. This disclosure offers visualizing embodiments according to the invention by way of example and not limitation. A person skilled in the art will conceive numerous other modifications and embodiments which are within the scope and the spirit of the principles according to the invention. One such other embodiment may consist in the novel conveyor rollers of the supply unit being disposed such that always the sheet of paper which is uppermost on the paper stack is drawn off and conveyed toward the supply slot 5. In the case of this embodiment the support face of the paper support is then correspondingly modified in a continuous manner in its height position, so as to correspond to the number of the paper sheets which have already been conveyed toward the supply slot 5. On account thereof, it is ensured that the upper sheet of paper of the paper stack always bears on the conveyor rollers or on at least one of the conveyor rollers, respectively.

It would be an alternative thereto for not the support face to be modified in its position but instead for at least one of the conveyor rollers to be variably adjustable, in particular variably adjustable in a continuous manner, in its position in relation to the upper sheet of paper of the paper stack.

While embodiments have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

LIST OF REFERENCE SIGNS

1 Document shredder
2 Housing
3 Door (front side of item 2)
4 Upper housing part (of item 2)
5 Supply slot (in item 4)
6 First conveyor roller
6*a* Roller body
6*b* Circumferential face/sleeve face (of item 6)
6*c* Rotation axle (of item 6)
7*a*, . . . 7*n* Area portions
8*a*, . . . 8*n* Edges of the area portions 7*a*, . . . 7*n*
9 Second conveyor roller
9*a* Roller body
9*b* Circumferential face/sleeve face (of item 9)
9*c* Rotation axle (of item 9)
10 Supply unit
11 Main body
12 Supporting parts
13 Guide part
14 Paper support
15 Support face
16 A manually supplied sheet of paper
17 Central front plate
18 Further roller (separation and contact roller)
18*c* Rotation axle (of item 18)
19 Ribs (on item 15)
20 Paper stack/document stack
21 Lowermost respective sheet of the paper stack 20
22 Cutting unit
P Conveying direction

The invention claimed is:

1. A unit for supplying sheet-like material for a document shredder, comprising:
- a paper support having a support face;
- a conveyor roller defining a sleeve face that includes a multiplicity of rectangular scales;
- a supply slot through which paper may be supplied to a cutting unit;
- wherein a stack of paper/sheet-like material may be supported on the support face and a sheet from the stack may be sheet-wise conveyed toward the supply slot by static friction between the sleeve face of the conveyor roller and the sheet.

2. The unit for supplying sheet-like material, according to claim 1,
- characterized in that,
- when viewed in a conveying direction and thus in a rotation direction of the conveyor roller, the rectangular scales of the sleeve face of the conveyor roller have in each case one edge radially projecting from the sleeve face.

3. The unit for supplying sheet-like material, according to claim 1,
- characterized in that,
- when viewed counter to a conveying direction and thus counter to a rotation direction of the conveyor roller, the rectangular scales of the sleeve face of the conveyor roller at least in part-regions are inwardly inclined in a radial direction.

4. The unit for supplying sheet-like material, according to claim 1,
- characterized in that,
- when viewed in a conveying direction and thus in a rotation direction of the conveyor roller, the rectangular scales of the sleeve face of the conveyor roller have in each case one edge radially projecting from the sleeve face, and also, when viewed counter to the conveying direction and thus counter to the rotation direction of the conveyor roller, are inwardly inclined in a radial direction, at least in part-regions.

5. The unit for supplying sheet-like material, according to claim 1, further comprising:

a slot-shaped exit shaped and disposed such that the sheet of paper from the stack is directly guided into the supply slot.

6. The unit for supplying sheet-like material, according to claim 1, characterized in that, a further roller is disposed above the conveyor roller and oriented so as to be parallel therewith, wherein the conveyor roller and the further roller are disposed so as to be spaced apart from one another such that a gap for passing through sheet-like material is formed therebetween; and when viewed in a conveying direction and thus in a rotation direction of the conveyor roller, the rectangular scales of the sleeve face have in each case one edge radially projecting from the sleeve face.

7. The unit for supplying sheet-like material, according to claim 1, characterized in that, a further roller is disposed above the conveyor roller and oriented so as to be parallel therewith, wherein the conveyor roller and the further roller are disposed so as to be spaced apart from one another such that a gap for passing through sheet-like material is formed therebetween; and when viewed in a conveying direction and thus in a rotation direction of the conveyor roller, the rectangular scales of the sleeve face of the conveyor roller have in each case one edge radially projecting from the sleeve face, and also, when viewed counter to the conveying direction and thus counter to the rotation direction of the conveyor roller, are inwardly inclined in a radial direction, at least in part-regions.

8. The unit for supplying sheet-like material, according to claim 1, further comprising:

a further roller disposed above the conveyor roller and oriented so as to be parallel therewith, wherein the conveyor roller and the further roller are disposed so as to be spaced apart from one another such that a gap for passing through sheet-like material is formed therebetween.

9. The unit for supplying sheet-like material, according to claim 8, wherein the further roller is movable in height in such a manner that a width of the gap formed is variably adjustable and/or is capable of automatically adapting to the thickness of the respective sheet of paper being conveyed therethrough.

10. A unit for supplying sheet-like material for a document shredder, comprising a paper support having a support face; a conveyor roller defining a sleeve face that includes a multiplicity of structured scales; wherein a stack of paper/sheet-like material may be supported on the support face and a sheet from the stack may be sheet-wise conveyed toward a supply slot by static friction between the sleeve face of conveyor roller and the sheet, characterized in that a further roller is disposed above the conveyor roller and oriented so as to be parallel therewith, wherein first conveyor roller and the further roller are disposed so as to be spaced apart from one another such that a gap for passing through sheet-like material is formed therebetween.

11. The unit for supplying sheet-like material, according to claim 10, characterized in that the conveyor roller and the further roller are each laterally held by a rotation axle so as to be rotatable.

12. The unit for supplying sheet-like material, according to claim 10, characterized in that the further roller is mounted so as to be movable in height in such a manner that a width of the gap formed is variably adjustable and/or is capable of automatically adapting to the thickness of the respective sheet of paper being conveyed therethrough.

13. The unit for supplying sheet-like material, according to claim 10, characterized in that the further roller includes a sleeve face with structured scales, wherein the scales on the sleeve face of the further roller are configured in the form of a rectangular scale pattern and/or in each case have one edge radially projecting from the sleeve face of the further roller, and/or when viewed counter to a rotation direction of the further roller, at least in part-regions are inwardly inclined in a radial direction.

14. The unit for supplying sheet-like material, according to claim 10, characterized in that, when viewed in a conveying direction and thus counter to a rotation direction of the conveyor roller, the rectangular scales of the sleeve face at least in part-regions are inwardly inclined in a radial direction.

* * * * *